US007222571B2

(12) United States Patent
Susen

(10) Patent No.: US 7,222,571 B2
(45) Date of Patent: May 29, 2007

(54) FAN-OUT CONTROL ASSEMBLY

(76) Inventor: Bradley Susen, 61 Mabel Dr., West Middlesex, PA (US) 16159

( * ) Notice: Subject to any disclaimer, the term of this patent is extended or adjusted under 35 U.S.C. 154(b) by 22 days.

(21) Appl. No.: 11/101,711

(22) Filed: Apr. 8, 2005

(65) Prior Publication Data

US 2005/0235856 A1 Oct. 27, 2005

Related U.S. Application Data

(60) Provisional application No. 60/564,506, filed on Apr. 22, 2004.

(51) Int. Cl.
*B65H 23/00* (2006.01)

(52) U.S. Cl. ..... 101/480; 101/484; 101/DIG. 42; 226/39; 226/195

(58) Field of Classification Search ..... None
See application file for complete search history.

(56) References Cited

U.S. PATENT DOCUMENTS 3,090,534 A * 5/1963 Frommer et al. ..... 226/21
3,147,898 A * 9/1964 Huck ..... 226/17
4,003,479 A * 1/1977 Reyer ..... 414/471
4,265,175 A * 5/1981 Smejda ..... 101/115
4,404,906 A 9/1983 Curran
4,696,230 A 9/1987 Barkley
5,383,393 A 1/1995 Ueda
5,419,248 A 5/1995 Brotzman
5,505,441 A 4/1996 Sugiyama
5,553,542 A * 9/1996 Jackson et al. ..... 101/228
5,619,921 A 4/1997 Iijima
5,782,182 A 7/1998 Ruckmann
6,021,713 A 2/2000 Glockner
6,024,504 A 2/2000 Weichmann
6,283,467 B1 9/2001 Iida
6,546,871 B1 4/2003 Glockner
6,604,463 B1 * 8/2003 Smith ..... 101/228
6,612,235 B2 9/2003 Frankenberger
6,705,219 B2 3/2004 Douillard

FOREIGN PATENT DOCUMENTS

GB 2030968 A * 4/1980

* cited by examiner

*Primary Examiner*—Daniel J. Colilla
*Assistant Examiner*—Jill E. Culler

(57) ABSTRACT

The present invention describes an assembly to control fan-out on a multi-color offset printing press. The assembly includes an arm that pushes the paper into proper alignment before the printing of a succeeding color. The assembly may be fitted to existing presses and may be adjusted to accommodate papers of various widths and moisture content.

20 Claims, 2 Drawing Sheets

FAN-OUT CONTROL ASSEMBLY

The present invention claims priority to provisional application No. 60/564,506, filed Apr. 22, 2004.

FIELD OF THE INVENTION

The invention relates to an assembly for use in the printing industry, specifically an assembly for improving print quality of a multi-color printing press.

BACKGROUND OF THE INVENTION

In recent years, many newspaper publishers have begun to print newspapers using a plurality of color inks. Color printing typically requires multiple stages involving a plurality of printing stations. The paper must remain geometrically aligned with each station. Demand has, therefore, increased for a press that can accurately print multi-colors without geometric errors.

One such error, known as fan-out, is caused by anisotropic expansion of paper during the printing process. Paper comprises pulp fibers having longitudinal and radial axes. Moisture causes the pulp fibers to expand. Each fiber tends to expand less than one percent in its longitudinal direction and twenty to thirty percent in its radial direction. The fibers' longitudinal axes extend generally parallel to the length of the paper sheet so that, when moistened, the paper sheet tends to expand significantly more along its width than its length.

Printing involves dampening the paper with water-based inks. This causes the paper to swell, thereby distorting images and lines printed on the paper. Distortion is most evident when printing a plurality of colors in a staged operation. Images created in a first printing station may not coincide with images created at a second or later print station. This includes, for example, misalignment of color pictures with their black borders and colors offset from one another. Print quality can be poor.

Prior art includes mechanical and electronic attempts to reduce fan-out. U.S. Pat. No. 4,404,906 teaches a bowed roller for applying outward lateral force to a paper web in order to expand the web prior to printing a first color. U.S. Pat. No. 5,419,248 describes a device that compensates for expansion of printing plates after successive passes through a print unit. The device includes a register pin for manually adjusting the position of the plate. U.S. Pat. No. 5,619,921 teaches the introduction of waves in a paper web to cancel any expansion caused by moisture expansion. U.S. Pat. No. 5,383,393 includes a plurality of register adjuster means, a paper drawing means downstream of the printing sections, and a plurality of width adjusting means between printing section. U.S. Pat. No. 4,696,230 describes an air nozzle for producing a bustle, or wave, in the paper web, thereby reducing the effective width of the paper web. U.S. Pat. No. 6,024,504 teaches a mathematical process for correcting geometric errors without mechanical intervention.

Prior art includes complex mechanical or electronic systems. Retrofitting to existing printing presses is difficult or expensive. A need exists for an article that reduces fan-out simply and inexpensively. Preferably, the article could be attached to an existing printing press and an operator could adjust fan-out correction during the printing process.

SUMMARY OF THE INVENTION

The present invention describes a fan-out control assembly. The assembly can be retrofitted to existing printing presses or included in new presses. The assembly permits press operators to correct fan-out and make adjustments during the printing process without the need for interrupting or stopping printing.

In a broad aspect, the fan-out control assembly comprises a base, an arm, a web guide and an adjusting rod. The base attaches to a fixed support such as the printing press, and supports the arm. The arm places the web guide in position against a paper web. The adjusting rod is attached to the base so that movement of the rod moves the base and arm. Movement may be rotational or translational. Movement of the base and arm adjusts the web guide against the paper web.

In one embodiment, the base includes a pivot having a threaded hole. The adjusting rod includes a handle and a threaded end that fits into the threaded hole. Turning the handle causes the base to pivot, thereby moving the web guide relative to the paper web. Preferably, the handle is accessible to an operator, who can make fan-out adjustments during printing.

In another embodiment, the assembly includes an arm having a length that can be changed to fit various printing presses. Arm length may be changed by providing two arm portions capable of relative movement. For example, the two portions may include two rods, a first having a threaded end and a second having a tapped end for receipt of the threaded end. Alternatively, clamps or a slot/hole arrangement permit changing arm length.

In one aspect, the web guide includes a conical element. The conical element is adapted to be placed against the edge of the paper web. The conical element pushes the paper web inward. Conveniently, the conical element is positioned after a first printing station and just before a second printing station.

BREIF DESCRIPTION OF THE DRAWINGS

DETAILED DESCRIPTION OF THE INVENTION

Figure 1:
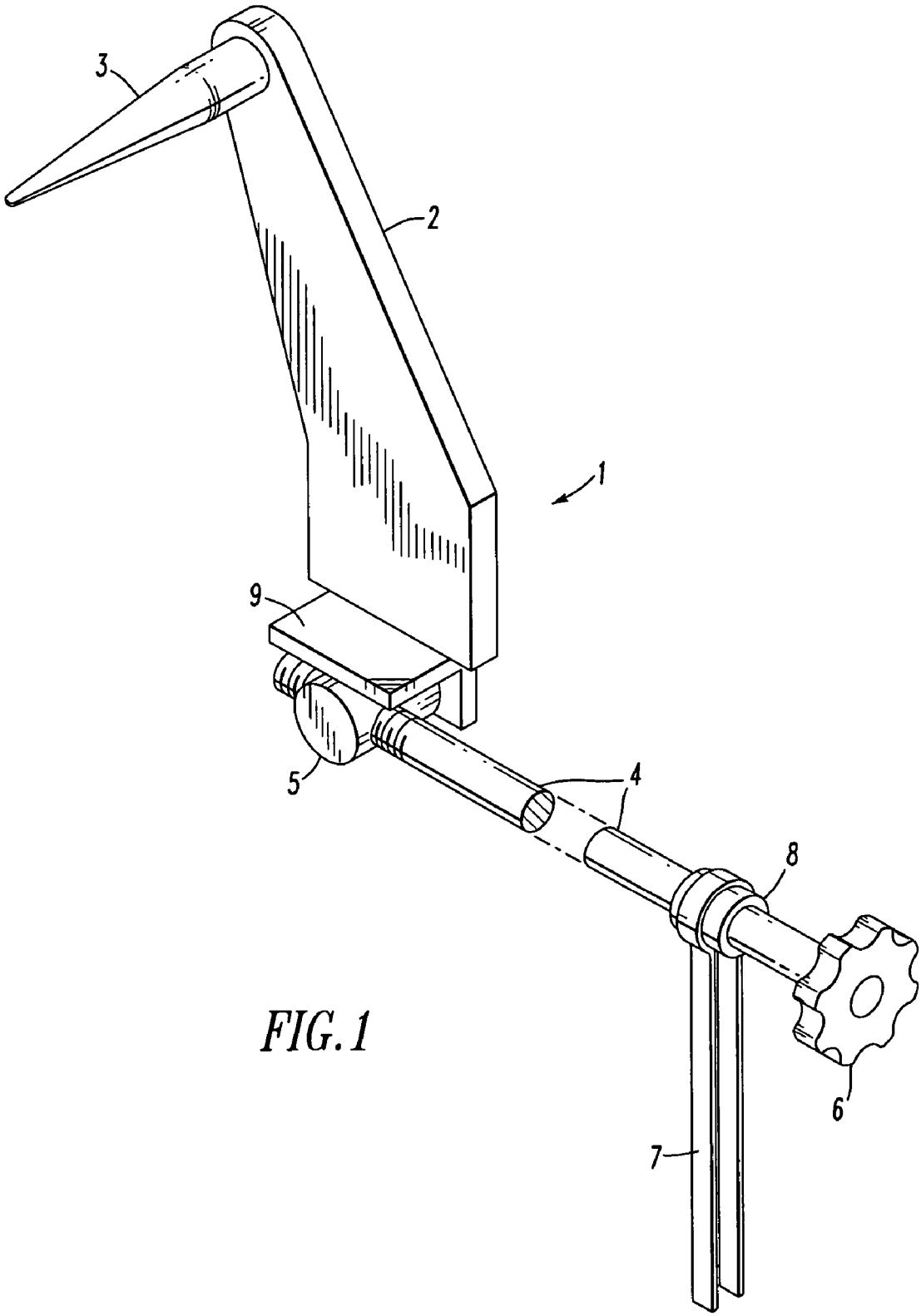
FIG. 1 shows the assembly of the present invention.

FIG. 1 shows an assembly 1 of the present invention. This embodiment of the assembly 1 includes a base 9, an arm 2, a web guide 3, an adjusting rod 4, a pivot 5 for receiving a first end of the adjusting rod 4, a handle 6 for movement of a second end of the adjusting rod 4 by an operator, and a support 7 for securing a collar 8 holding the second end of the adjusting rod 4. The base 9 supports the other elements and is most commonly secured to a printing press. The base 9 may be supported by an element extrinsic to the press. In either case, the base 9 should be movable, either in translation or rotation or both, relative to the press.

The arm 2 attaches to the base 9 and supports the web guide 3. The arm 2 can be made into any convenient shape depending on press geometry and may even be adjustable. An angled arm, such as shown in FIG. 1, may be preferable over a straight arm. Conveniently, the length of the arm may be adjusted to accommodate various printing presses. One skilled in the art would appreciate a number of ways to produce an arm having an adjustable length. For example, the arm may comprise a first part having a threaded end and a second part having a tapped end. Varying the depth the threaded end is screwed into the tapped end changes the length of the arm. Alternatively, the arm includes first and second parts fastened with a bracket that, when loosened, permit the parts to slide relative to each other thereby changing the length of the arm. One such bracket includes a slot in the first part and a plurality of holes in the second part. The slot permits the length of the arm to change. Aligning the slot and holes permits insertion of securing fasteners through the slot and holes. The fasteners may be removable, such as screws, so that the length of the arm can be changed at a later time.

The web guide 3 is adapted to rest against a paper web and to push a paper web inward. The web guide typically rests at least in part against the edge of the paper web. In order to push the paper inward, the web guide 3 must intersect the plane of the paper web but should include a portion angled from the plane of the paper. The angle facilitates adjustment by permitting the web guide to remain in contact with the paper web when the arm 2 is moved. The angled portion may include a bar, rod, conical or frusto-conical element. The angled portion diverges from the plane of the paper web at an angle that is steep enough to push in the web but shallow enough not to disrupt or tear the paper web. A convenient angle has been shown to range from 20-60 degrees.

The adjusting rod 4 is adapted to move the base 9 relative to the printing press, thereby changing the position of the web guide 3 relative to the press and, ultimately, to a paper web running through the press. The rod 4 may, for example, lift up or down, pull in or out, but greater precision has been found using a threaded connection.

The embodiment of FIG. 1 includes a pivot 5 having a threaded hole for receiving a threaded end of the adjusting rod 4. Screwing the threaded end into or out of the threaded hole changes the position of the base relative the press. In this case, rotating the base relative to the press. The pivot 5 permits the threaded hole to stay aligned with the rod 4 as adjustments are made. The embodiment also includes a rod support 7 that stabilizes the rod 4 relative to the press. Conveniently, the support 7 is fixedly secured to the press. The support 7 may include one or more set collars 8 that permit fixing the rod in all three spatial dimensions. The rod 4 may include a handle 6 to facilitate movement of the rod 4. The handle 6 should extend to a position where a press operator could move the handle while the press is running.

Figure 2:
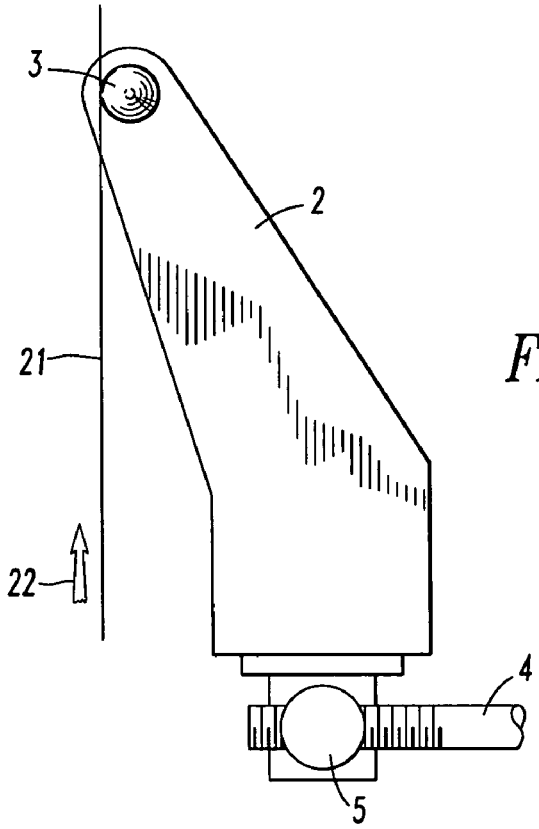
FIG. 2 shows a side view of the present invention.
Figure 3:
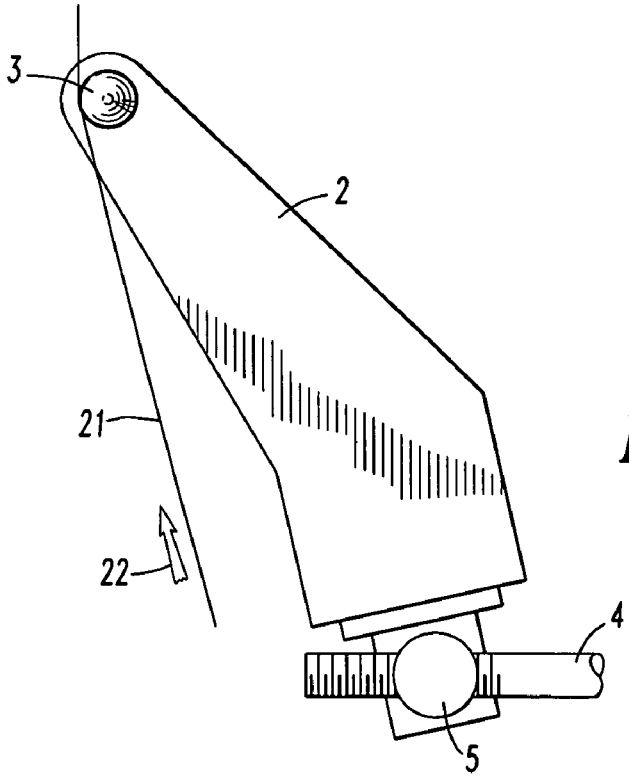
FIG. 3 shows a side view of the present invention with the web guide pressing against the paper web.

FIG. 2 shows the assembly installed on a printing press. The web guide 3 in this embodiment has a conical shape, and presses against the paper web 21. Pressing the conical web guide 3 against the paper web 21, as shown in FIG. 3, restricts expansion of the paper web 21 in a directional orthogonal to the print direction 22. The web guide 3 is supported by the arm 2. The pivot 5 includes a threaded hole for receiving a threaded end of the rod 4. Rotating the rod 4 causes the base 9 to move, thereby moving the web guide 3 relative to the paper web 21. Moving the web guide 3 against the paper web 21 restricts fan-out. The web guide frequently induces a curl in edge of the paper web. The curl pushes in the paper web, thereby reducing the expansion of the web during printing.

The assembly may be attached to a part of the printing press, such as a structural brace. A suitable brace normally exists on the press, but a brace may be added if necessary. Moving the rod 4 causes the base 9 to move relative to the brace. The arm follows the movement of the base and either moves the web guide 3 against or away from the paper web 21.

The base may include a support and a bracket, which are secured together around the brace. Alternatively, the base and arm may join so as to fix the combination to the brace. The base or base/arm combination may be removably secured to the brace, such as with screws or clamps, so that the base may be moved to different positions along the brace. Such movement permits the use of paper webs of various widths. Movement is conveniently provided using, for example, a screw/slot configuration. The base/arm combination may even permit the arm to move in relation to the base, thereby providing even more flexibility and permitting the web guide to contact webs of nearly any width.

A plurality of assemblies may be used on a press with multiple printing stations. An assembly may be placed before each printing section after the first section. For example, in a four color press, three assemblies may be used, one before each of the second, third and fourth section. More than one assembly may even be used before each section.

Obviously, numerous modifications and variations of the present invention are possible. It is, therefore, to be understood that within the scope of the following claims, the invention may be practiced otherwise than as specifically described. While this invention has been described with respect to certain preferred embodiments, different variations, modifications, and additions to the invention will become evident to persons of ordinary skill in the art. All such modifications, variations, and additions are intended to be encompassed within the scope of this patent, which is limited only by the claims appended hereto.

What is claimed:

1. An assembly for controlling fan-out of a continuous paper web during multi-stage printing comprising:

a) a base;

b) an arm secured to the base;

c) a web guide secured to the arm, the web guide including an angled portion that is not coplanar with the paper web and is capable of acting on an edge of the paper web during printing; and d) an adjusting rod having a first end cooperating with the base and a second end, whereby movement of the second end moves the web guide.

2. The assembly of claim 1, wherein the base comprises a pivot for receiving the first end of the adjusting rod and movement of the second end rotates the base.

3. The assembly of claim 2, wherein the pivot includes a threaded hole and the first end is threaded and cooperates with the threaded hole, whereby rotation of the second end causes the base to rotate.

4. The assembly of claim 1, wherein the base and first end cooperate through a threaded connection.

5. The assembly of claim 1, wherein the arm is not straight.

6. The assembly of claim 1, wherein the arm includes an adjustable length.

7. The assembly of claim 6, wherein the adjustable length comprises first and second parts fastened with a bracket.

8. The assembly of claim 7, wherein the bracket comprises a slot in the first part, a plurality of holes in the second part, and a plurality of fasteners passing through the slots into the holes, whereby the adjustable length can be fixed.

9. The assembly of claim 1, wherein the angled portion is selected from a group consisting of a bar, rod, conical element and frusto-conical element.

10. The assembly of claim 1, wherein the angled portion and a plane of the paper web form an angle from 20-60 degrees.

11. A printing press for multi-stage printing of a continuous paper web comprising a fan-out control assembly comprising a base, an arm attached to the base, a web guide attached to the arm, the web guide including an angled portion that is not coplanar with the paper and is capable of pushing inwardly an edge of the paper web during printing, and an adjusting rod having a first end cooperating with the base and a second end, whereby movement of the second end moves the web guide relative to the paper web.

12. The printing press of claim 11, wherein the base is secured to the printing press.

13. The printing press of claim 11, wherein the second end of the adjusting rod is secured to the printing press by a support and at least one collar.

14. The printing press of claim 11, wherein the angled portion is selected from a group consisting of a bar, rod, conical element and frusto-conical element.

15. The assembly of claim 11, wherein the arm includes an adjustable length.

16. An assembly for controlling fan-out of a continuous paper web during multi-stage printing comprising:

a) a base comprising a pivot having a threaded hole;

b) an arm secured to the base;

c) a web guide secured to the arm and capable of pushing inwardly an edge of the paper web during printing, the web guide including an angled portion selected from a group consisting of a bar, rod, conical element and frusto-conical element, the angled portion and a place of the paper web forming an angle from 20-60 degrees; and d) an adjusting rod having a threaded end cooperating with the threaded hole of the pivot, and a second end, whereby movement of the second end moves the web guide.

17. The assembly of claim 16, wherein the arm is not straight.

18. The assembly of claim 16, wherein the arm includes an adjustable length.

19. The assembly of claim 18, wherein the adjustable length comprises first and second parts fastened with a bracket.

20. The assembly of claim 19, wherein the bracket comprises a slot in the first part, a plurality of holes in the second part, and a plurality of fasteners passing through the slots into the holes, whereby the adjustable length can be fixed.

* * * * *